US006478295B2

(12) United States Patent
Hwang et al.

(10) Patent No.: US 6,478,295 B2
(45) Date of Patent: Nov. 12, 2002

(54) PAPER DISCHARGING APPARATUS FOR PRINTER

(75) Inventors: Seung-taik Hwang, Seoul (KR); Jong-sung Jung, Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 30 days.

(21) Appl. No.: 09/860,588

(22) Filed: May 21, 2001

(65) Prior Publication Data

US 2002/0096823 A1 Jul. 25, 2002

(30) Foreign Application Priority Data

Jan. 22, 2001 (KR) ..... 01-3583

(51) Int. Cl.[7] ..... B65H 3/06

(52) U.S. Cl. ..... 271/115; 271/121; 271/122; 271/127; 400/629

(58) Field of Search ..... 271/121, 114, 271/115, 122, 127; 400/629

(56) References Cited

U.S. PATENT DOCUMENTS

| | | | | | |
|---|---|---|---|---|---|
| 4,892,299 | A | * | 1/1990 | Hayama | 271/122 |
| 5,213,426 | A | * | 5/1993 | Ewing | 271/126 |
| 5,316,285 | A | * | 5/1994 | Olson et al. | 271/121 |
| 5,324,018 | A | * | 6/1994 | Miura et al. | 271/122 |
| 5,725,208 | A | * | 3/1998 | Miyauchi | 271/121 |
| 5,895,038 | A | * | 4/1999 | Takashima | 271/127 |
| 5,901,951 | A | * | 5/1999 | Yamaguchi | 271/122 |
| 6,382,621 | B1 | * | 5/2002 | Inoue et al. | 271/121 |

* cited by examiner

*Primary Examiner*—H. Grant Skaggs
(74) *Attorney, Agent, or Firm*—Robert E. Bushnell, Esq.

(57) ABSTRACT

A paper discharging apparatus for a printer includes: a plurality of support plates for supporting the paper and rotating in a direction parallel to a paper proceeding direction; a rotation shaft of a feed roller arranged in a direction perpendicular to the paper proceeding direction, and to which a feed roller contacting the paper is coupled; a power transfer portion having a sector gear installed on the rotation shaft so that the sector gear doe not rotate when the rotation shaft rotates in a forward direction, and the sector gear does rotate when the rotation shaft rotates in a reverse direction; a crank rod having one end connected to the sector gear, and reciprocating when the sector gear rotates; and a cam shaft connected to the crank rod and rotating in correspondence to the reciprocation of the crank rod. A cam for performing interference movement relative to the support plates, and a holder engaged with the rotation of the cam shaft and having a plurality of kickers for pushing the paper toward the support plate, are also provided. When the sector gear rotates in a forward direction, the paper is supplied or printed; when the sector gear rotates in a reverse direction, the holder is engaged with the cam shaft to perform angular movement by means of the crank rod connected to the sector gear so that an end portion of the paper is pushed. The paper is supported by the support plates, and is dropped downward and stacked. Thus, by using a power transfer portion having a simple structure, cost can be reduced and printing speed can be improved. Also, by using a crank rod and a cam shaft, discharged paper can be stably stacked without being damaged so that the paper can be stably discharged from the printer.

31 Claims, 11 Drawing Sheets

PAPER DISCHARGING APPARATUS FOR PRINTER

CLAIM OF PRIORITY

This application makes reference to, incorporates the same herein, and claims all benefits accruing under 35 U.S.C. §119 from my application PAPER EXTRACTING APPARATUS FOR PRINTING DEVICE filed with the Korean Industrial Property Office on Jan. 22, 2001 and there duly assigned Ser. No. 3583/2001.

BACKGROUND OF THE INVENTION

1. Technical Field

The present invention relates to a paper discharging apparatus for a printer designed to prevent damage to a sheet of paper so that the sheet of the paper can be stably stacked.

2. Related Art

A conventional star wheel type paper discharging apparatus includes a plurality of star wheels installed in a row and at predetermined intervals. Each star wheel has a ratchet formed along an outer circumference thereof so that the star wheels catch a sheet of paper while rotating. A discharge roller has a plurality of grooves formed thereon to correspond to each ratchet so that the discharge roller can discharge the paper while rotating in contact with the star wheels.

In the prior paper discharging apparatuses, when paper is discharged between the star wheel and the discharge roller, a trace of the ratchet is generated on the paper, thus damaging the paper so that the quality of print is lowered. In addition, paper passing through such paper discharging apparatuses is not stably stacked.

Certain paper discharging apparatuses employ wings for guiding paper discharged by a holder so that the paper is stacked in a stable manner. However, in such paper discharging apparatuses, since a print head transfer mechanism must be moved to a power transfer apparatus to operate the holder and the wings, the speed of print is lowered.

Arrangements to solve the above problems have been made or suggested, but such arrangements present additional problems. For example, such arrangements cause an increase in the bottom margin of the paper where printing is not possible.

SUMMARY OF THE INVENTION

To solve the above problems, it is an object of the present invention to provide a paper discharging apparatus for a printer in which a paper discharge holder and a support plate are operated by using a crank rod and a cam shaft so that sheets of printed paper are discharged with no damage and the papers can be stably stacked in a printing apparatus.

Accordingly, to achieve the above object, there is provided a paper discharging apparatus for a printer comprising: a plurality of support plates for supporting the paper installed at both sides of a paper proceeding direction at a base frame, and rotating in a direction parallel to the paper proceeding direction; a rotation shaft of a feed roller arranged in a direction perpendicular to the paper proceeding direction, a feed roller contacting the paper being coupled to the rotation shaft; a power transfer portion having a sector gear installed on the rotation shaft of the feed roller so that the sector gear does not rotate when the rotation shaft of the feed roller rotates in a forward direction, but does rotate when the rotation shaft of the feed roller rotates in a reverse direction; a crank rod having one end connected to the sector gear and reciprocating when the sector gear rotates; a cam shaft connected to the crank rod and rotating in correspondence to the reciprocation of the crank rod, a cam being connected thereto for performing interference movement with respect to the support plates; and a holder engaged with the rotation of the cam shaft and having a plurality of kickers for pushing the paper toward the support plates. In accordance with the invention, when the sector gear rotates in the forward direction, the paper is supplied or printed, and when the sector gear rotates in the reverse direction, the holder is engaged with the cam shaft, performing angular movement, by the crank rod connected to the sector gear so that the end portion of the paper is pushed, and the paper is supported by the support plate, and dropped downward and stacked.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
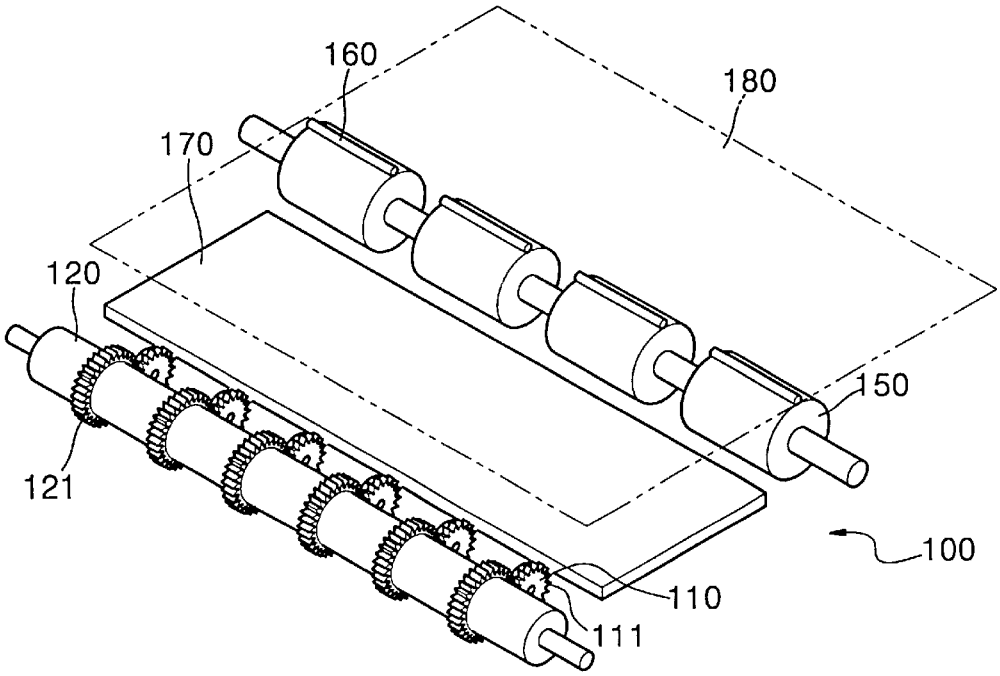
FIG. 1 is a perspective view showing the structure of a star wheel type paper discharging apparatus.

FIG. 1 shows the structure of a star wheel type paper discharging apparatus. Referring to the drawing, the paper discharging apparatus 100 includes a plurality of star wheels 110 installed in a row and at predetermined intervals, each star wheel 110 having a ratchet 111 formed along the outer circumference thereof so that the star wheels 110 can catch a sheet of paper 180 while rotating. A discharge roller 120 has a plurality of grooves 121 for med thereon in correspondence to the ratchets 111 of the star wheels 110 so that the discharge roller 120 can discharge the paper 180 while rotating in contact with the star wheels 110.

In the paper discharging apparatus 100 having the above structure, the paper 180 is supplied by being inserted between a feed roller 150 and a pinch roller 160, and is supported by a base frame 170. As the paper 180 is discharged by being inserted between the star wheel 110 and the discharge roller 120, a trace of the ratchet 111 is generated on the paper 180. Thus, the paper 180 is damaged so that the quality of print is lowered. Also, the paper 180 passing through the paper discharging apparatus 100 is not stably stacked.

Figure 2:
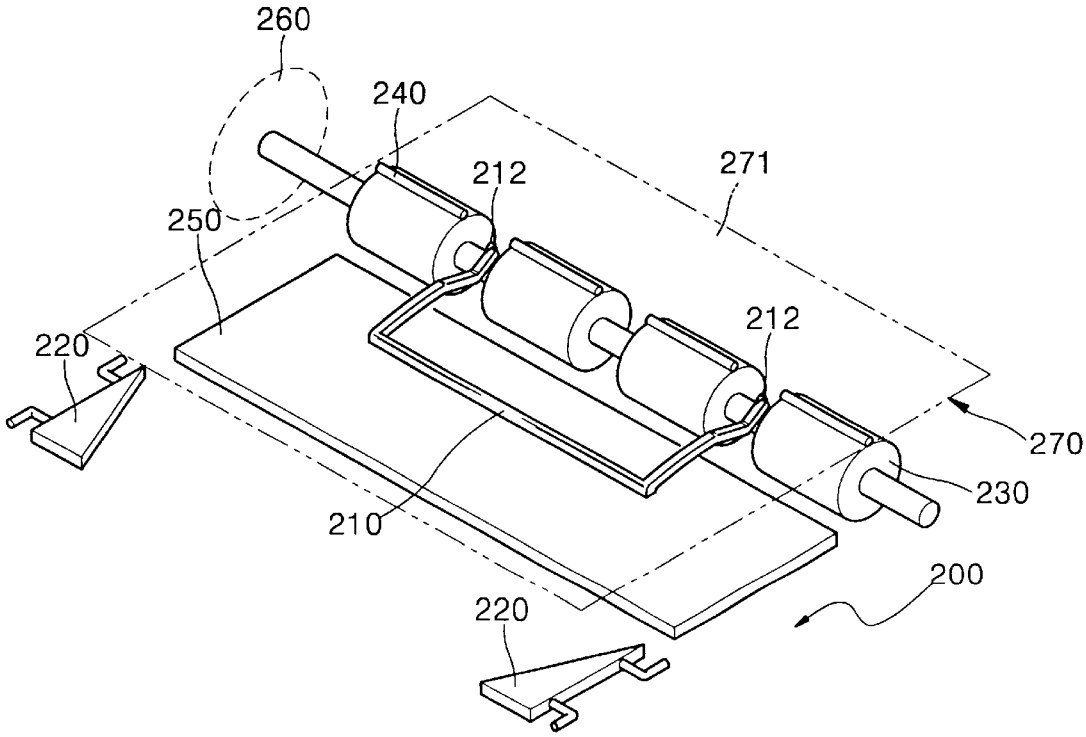
FIG. 2 is a perspective view showing the structure of a kicker type paper discharging apparatus.

FIG. 2 shows the structure of a kicker type paper discharging apparatus. Referring to the drawing, the kicker type paper discharging apparatus 200 includes a holder 210 having two kickers 212 for pushing an end portion 271 of a sheet of paper 270 out of the printer, and two wings 220 for guiding the paper 270 discharged by the holder 210 so that it is stacked in a stable manner.

In the kicker type paper discharging apparatus 200 having the above structure, the paper 270 is supplied along a contact surface between a feed roller 230 and a pinch roller 240 which are rotating, and is supported by a base frame 270. At a predetermined point where the paper 270 passes a paper sensing sensor (not shown), a print head transfer mechanism (not shown) moves to a power transfer apparatus 260 and changes the engagement state of gears (not shown) of the power transfer apparatus 260. The kickers 212 of the holder 210 push the end portion 271 of the paper 270. Simultaneously, the wings 220 supporting the paper 270 spread wide to drop the paper 270 so that the paper 270 falls and is stably stacked.

However, in the above kicker type paper discharging apparatus 200, since the print head transfer mechanism must be moved to the power transfer apparatus 260 located at the left portion in FIG. 2 in order to operate the holder 210 and the wings 220, the speed of print is lowered.

Figure 3A:
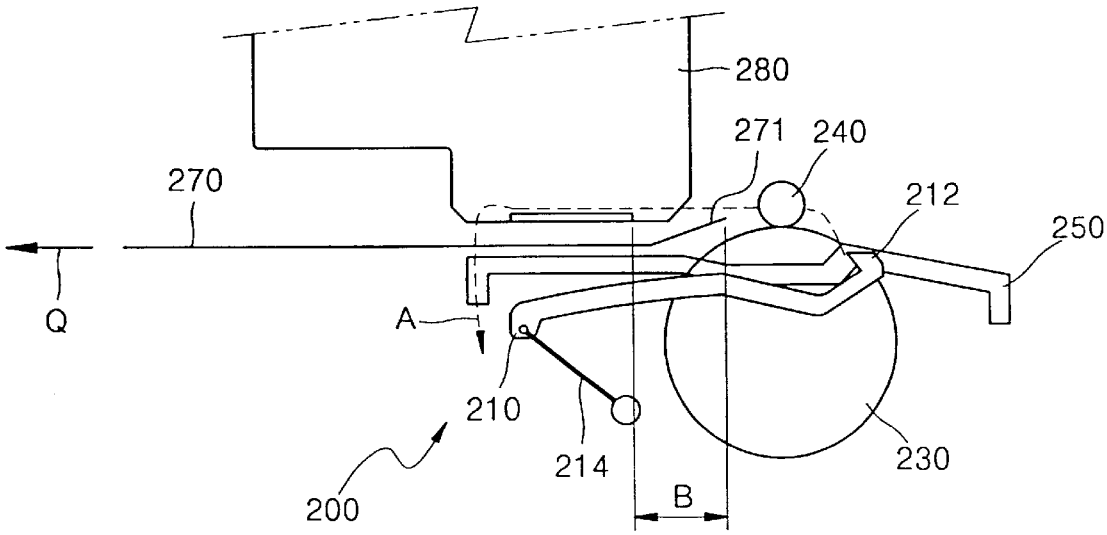
FIG. 3A is a view showing the operation of the kicker discharging the paper in the paper discharging apparatus of FIG. 2.
Figure 3B:
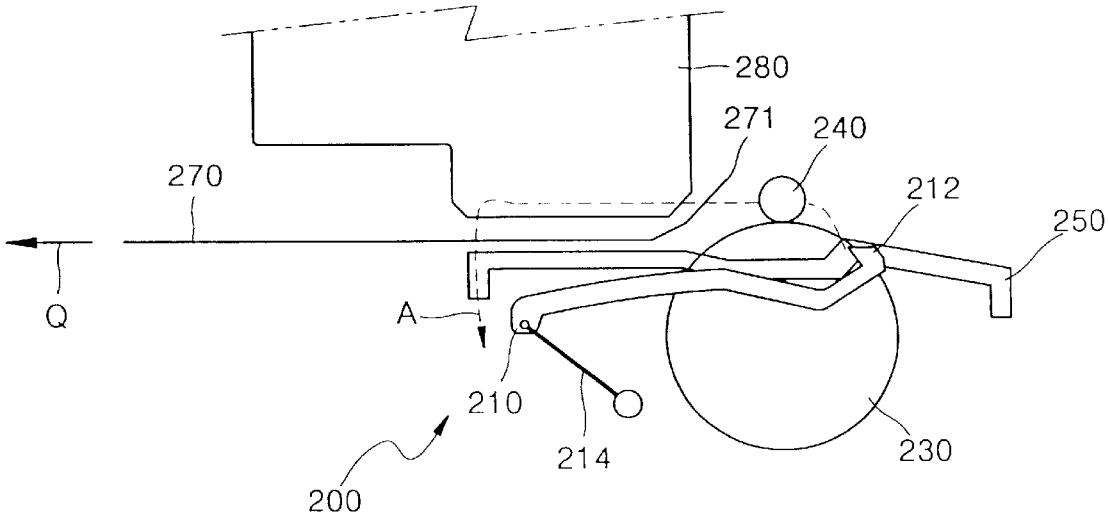
FIG. 3B is a view showing the operation of the kicker discharging the paper where a paper curl is generated in the paper discharging apparatus of FIG. 2.

FIG. 3A shows the operation of the kickers discharging the paper in the paper discharging apparatus shown in FIG. 2. FIG. 3B shows the operation of the kickers discharging paper which is curled up. In these figures, identical reference numerals are used to denote identical elements having identical functions.

Referring to FIG. 3A, the paper discharging apparatus 200 includes the holder 210 having a kicker 212 for pushing the paper 270, and a crank rod 214 for operating the holder 210 so that the paper can be discharged from the printer.

The paper 270 is supplied by being inserted between the feed roller 230 and the pinch roller 240 while being supported by the base frame 250, and is provided to the print head 280 for printing. When the end portion 271 of the paper 270 has passed between the feed roller 230 and the pinch roller 240, the holder 210 is rotated by the crank rod 214. The kicker 212, provided on the holder 210, moves along a path indicated by a dotted arrow A so that the end portion 271 of the paper 270 is pushed in a direction indicated by an arrow Q.

However, referring to FIG. 3B, when the end portion 271 of the paper 270 curls up, since the path indicated by the dotted arrow A, and along which the kicker 212 of the holder 210 moves, is located under the end portion 271 of the paper 270, the paper 270 is not appropriately pushed in the direction indicated by the arrow Q.

To solve the above problem, kicking action of the holder 210 can be initiated from a position where the end portion 271 of the paper 270 is positioned on the feed roller 230. In this case, although the function of pushing the paper 270 to advance it improves, there is an increase in the bottom margin of the paper 270 where print is not possible. This increased bottom margin is indicated by reference letter B in FIG. 3A.

Figure 4:
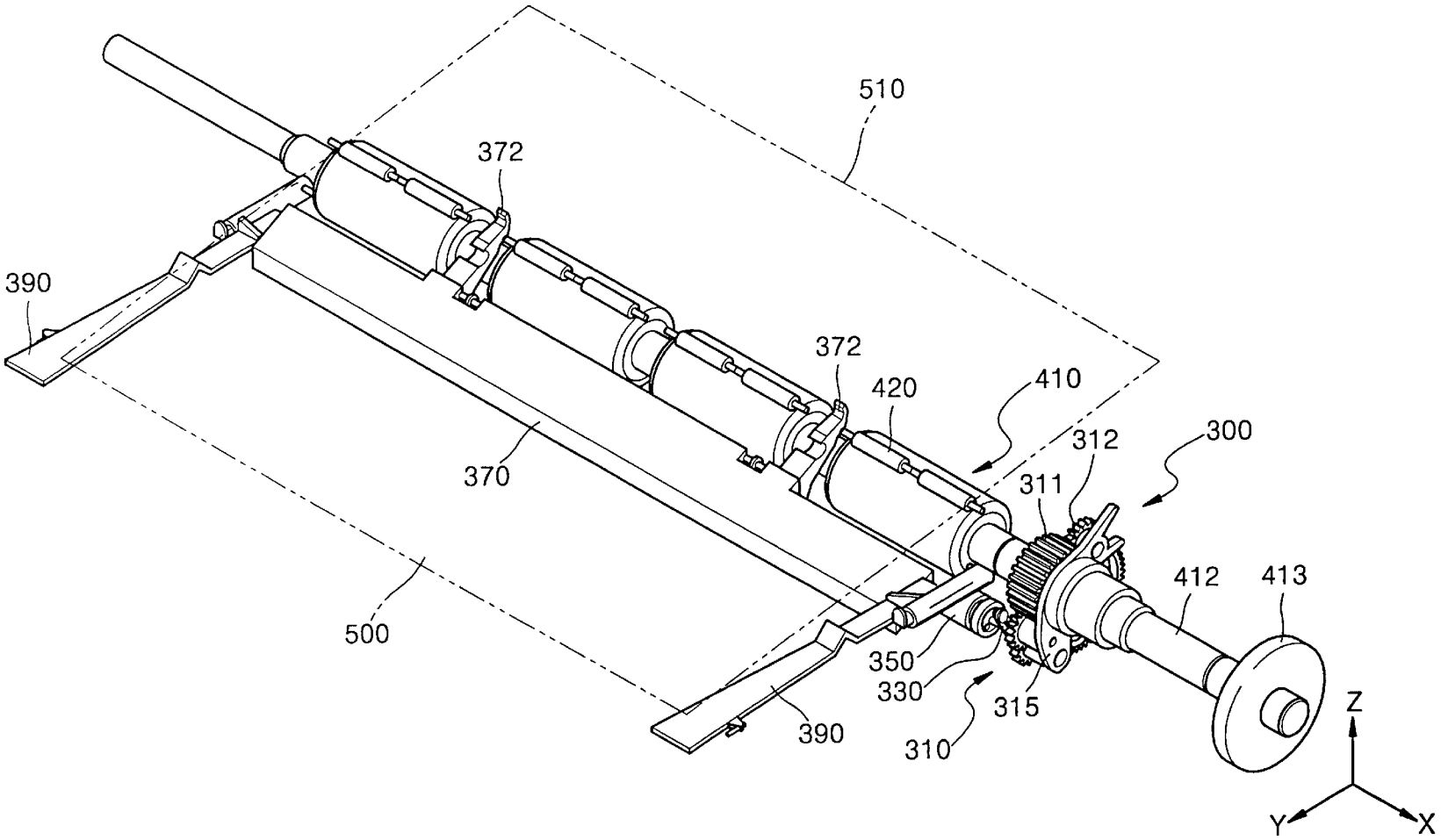
FIG. 4 is a perspective view showing a paper discharging apparatus according to a first preferred embodiment of the present invention.

Referring to FIG. 4, in a paper discharging apparatus 300 according to a first preferred embodiment of the present invention, feed rollers 410 for discharging a sheet of paper 500 are arranged at predetermined intervals on a rotation shaft 412 and in a middle portion thereof. A rotation wheel 413 is fixed at one end portion of the rotation shaft 412. Pinch rollers 420 for pressing the paper 500 against the feed rollers 410 are installed adjacent to each of the feed rollers 410. A power transfer portion 310 is arranged between the rotation wheel 413 and the feed rollers 410, and adjacent to the rotation wheel 413.

The power transfer portion 310 includes a toggle plate 315 which is installed on the rotation shaft 412 so as to be capable of performing relative rotation with respect to the rotation shaft 412. A discharge gear 311 is arranged adjacent to the toggle plate 315. The toggle plate 315 is fixed to the rotation shaft 412 so that it rotates together with the rotation shaft 412. The toggle plate 315 includes a first idle gear 312 and a third idle gear 314 (see FIG. 5) which are selectively engaged with a sector gear 316 to be described later, according to the position to which the toggle plate 315 pivots. A second idle gear 313 is installed adjacent to the third idle gear 314.

One end portion of the crank rod 330 is coupled so as to be capable of pivoting at an eccentric position on one side of the sector gear 316, while the other end portion thereof is coupled to a cam shaft 350. The structure of the cam shaft 350 will be described later. A holder 370, in which kickers 372 are provided, is arranged adjacent to and parallel to the feed rollers 410, and support plates 390 are installed at both sides of the holder 370.

Figure 5:
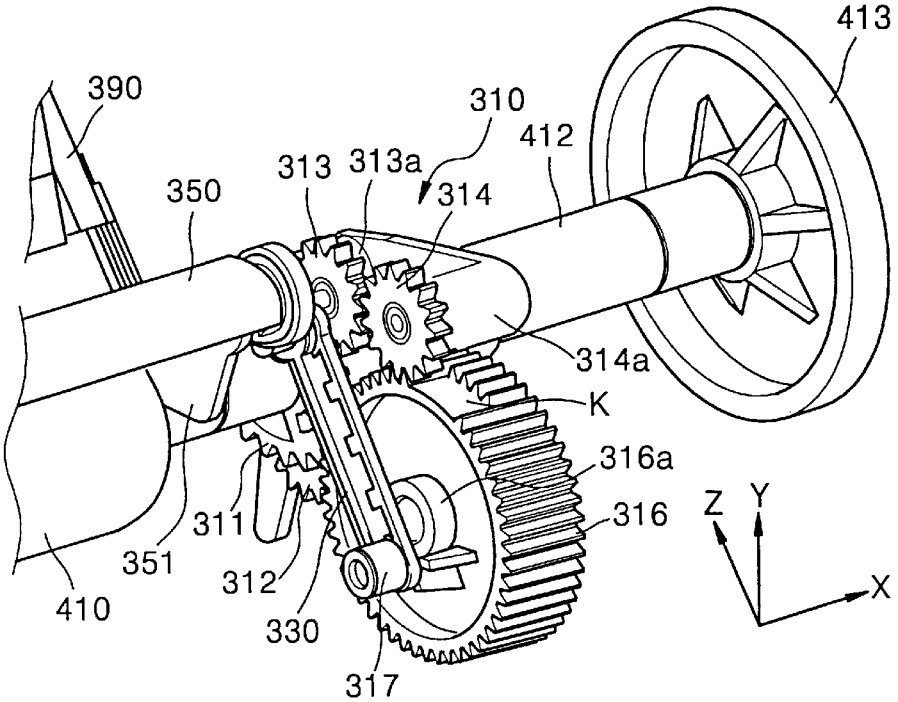
FIG. 5 is a perspective view showing the power transfer portion of the paper discharging apparatus according to the first preferred embodiment of the present invention.
Figure 6:
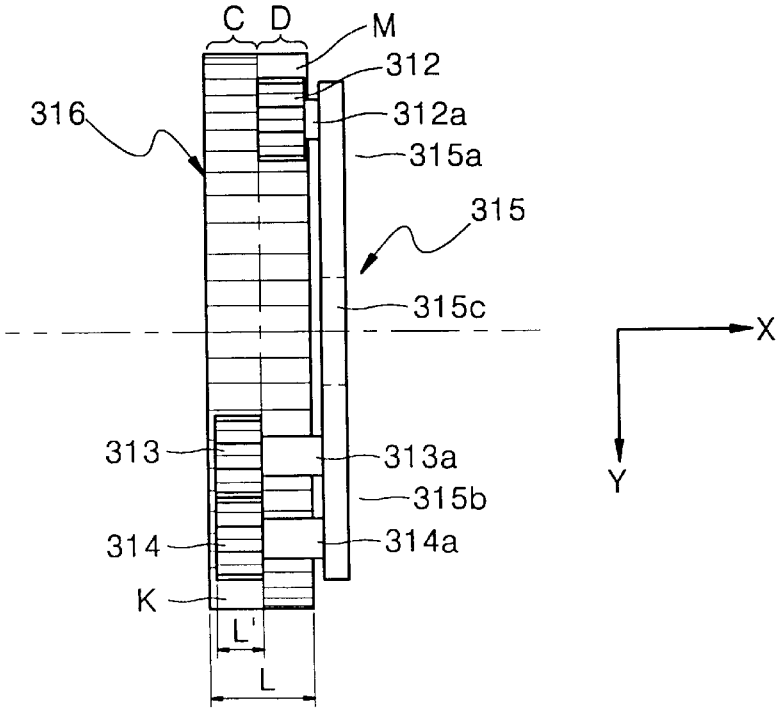
FIG. 6 is a view showing the toggle plate of the paper discharging apparatus according to the first preferred embodiment of the present invention.

FIG. 5 shows the power transfer portion 310 of the paper discharging apparatus 300 for a printer according to the first preferred embodiment of the present invention. FIG. 6 shows a state in which the toggle plate 315 and the sector gear 316 are assembled in the paper discharging apparatus 300.

Referring to FIGS. 5 and 6, the power transfer portion 310 includes the discharge gear 311 coupled to the rotation shaft 412 of the feed roller 410, the toggle plate 315 rotatably coupled to the rotation shaft 412, and the sector gear 316 selectively engaged with the first idle gear 312 and the third idle gear 314 (to be described later) according to the rotation of the toggle plate 315.

A through hole 315*c* is formed at the center of the toggle plate 315. A first rotational protrusion 312*a* is provided at one side 315*a* of the toggle plate 315, and second and third rotational protrusions 313*a* and 314*a*, respectively, are provided at the other side 315*b*. The rotation shaft 412, to which the rotation wheel 413 is fixed, is rotatably inserted into the through hole 315*c*. The first idle gear 312 is coupled to the first rotational protrusion 312*a* so as to be capable of pivoting, while the idle gears 313 and 314 are coupled to the second and third rotational protrusions 313*a* and 314*a*, respectively, so as to be capable of pivoting. The idle gears 313 and 314 are engaged together. The face widths L' of the idle gears 312, 313 and 314 are identical (see FIG. 6). Also, the idle gears 312, 313 and 314 are engaged with the discharge gear 311.

The sector gear 316 has a face width divided into areas C and D arranged in a radial direction with respect to the rotation shaft 412. The face width L of the sector gear 316 is equal to or greater than the sum of the face widths L' of the idle gears 312 and 314. The third idle gear 314 is engaged in the area C, and the first idle gear 312 is engaged in the area D.

In the sector gear 316, a first flat portion M (where teeth are not formed) is provided in the area D, and a second flat portion K (where teeth are not formed) is provided in the area C. The first and second flat portions M and K, respectively, are separated by a predetermined distance. Thus, when the rotation shaft 412 rotates in a forward direction (counterclockwise), the third idle gear 314 approaches the second flat portion K of the sector gear 316. However, since no teeth are formed on the second flat portion K, the third idle gear 314 cannot be engaged with the sector gear 316 and, as a result, the sector gear 316 cannot rotate. Also, when the rotation shaft 412 rotates in the reverse direction (clockwise), the first idle gear 312 rotates by being engaged with teeth in the area D. However, since no teeth are formed in the first flat portion M, the first idle gear 312 cannot rotate any further after one turn.

Figure 8:
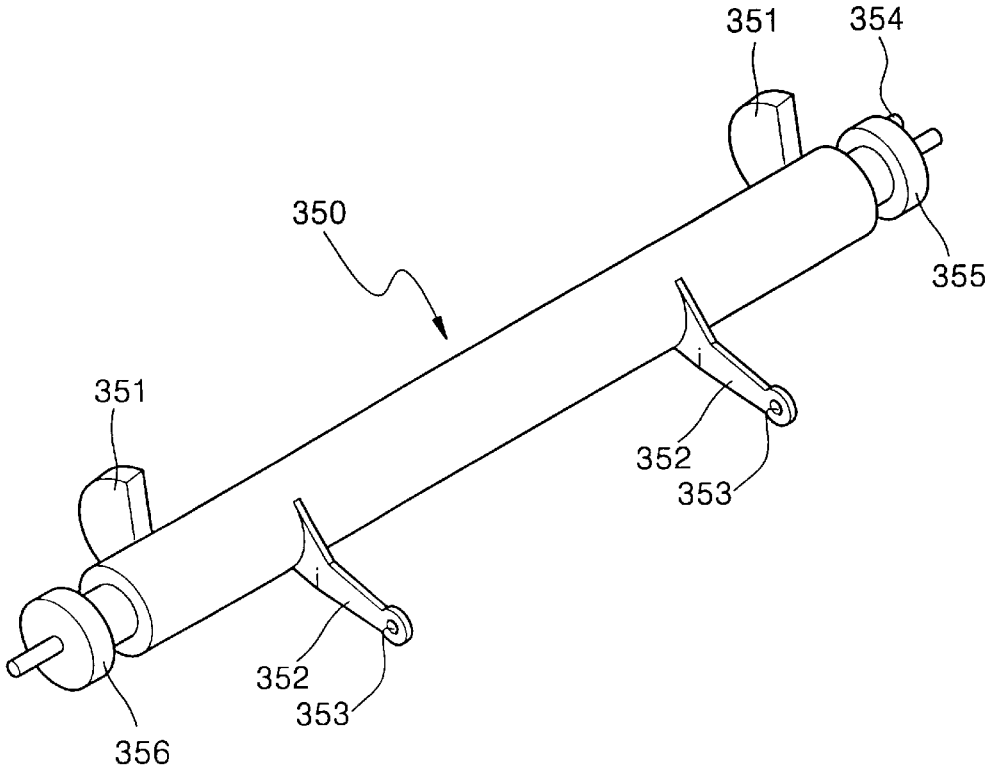
FIG. 8 is a perspective view showing the cam shaft of the paper discharging apparatus according to the first preferred embodiment of the present invention.

A first rotation shaft 317 is provided on the sector gear 316 so as to be eccentric with respect to a rotation shaft 316*a*. One end of a crank rod 330 is coupled to the first rotation shaft 317 so as to be capable of pivoting. The other end of the crank rod 330 is coupled so as to be capable of pivoting to a second rotation shaft 354 provided on a crank wheel 355 of the cam shaft 350, as shown in FIG. 8. Thus, as the sector gear 316 rotates, the crank rod 330 pivots and reciprocates with respect to the first rotation shaft 317 so that the cam shaft 350 performs a particular angular movement.

Figure 7:
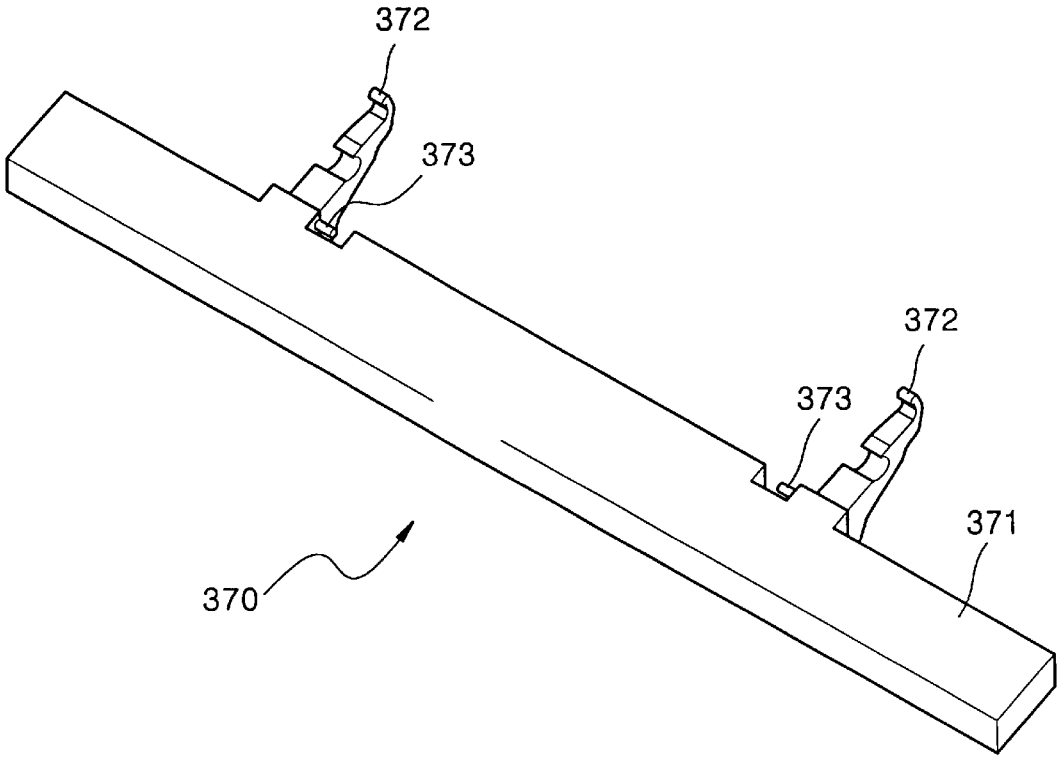
FIG. 7 is a perspective view showing the holder of the paper discharging apparatus according to the first preferred embodiment of the present invention.

FIG. 7 shows the holder 370 of the paper discharging apparatus for a printer according to the first preferred embodiment of the present invention. Referring to the drawing, the holder 370 includes a base 371 and a plurality of kickers 372 extending perpendicularly, by a predetermined length, from the base 371. Also, a plurality of hinge shafts 373 are connected to arms 352 of the cam shaft 350. The kickers 372 may have various shapes so long as they are capable of pushing an end portion 510 of the paper 500 so as to discharge the paper 500.

FIG. 8 shows the cam shaft 350 of the paper discharging apparatus 300 for a printer according to the first preferred embodiment of the present invention. Referring to FIG. 8, cams 351 are provided at respective end portions of the cam shaft 350. The arms 352 for connecting the holder 370 are provided on the cam shaft 350. The cams 351 supporting the support plates 390, shown in FIG. 4, are separated from the support plates 390 as the cam shaft 350 begins to rotate.

Figure 14:
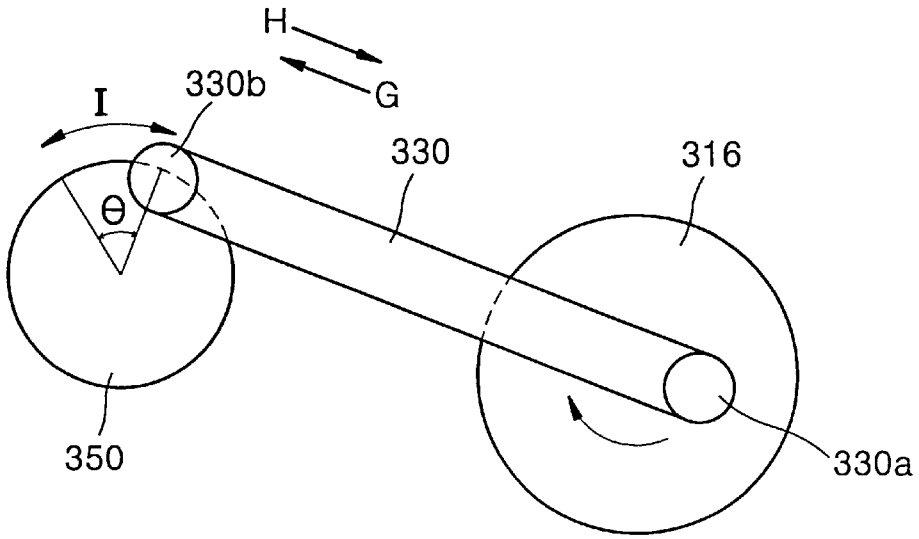
FIG. 14 is a view showing the operation of the crank rod and the cam shaft when the paper discharging apparatus of FIG. 4 rotates in the reverse direction.

Also, the crank wheels 355 and 356 are installed at respective end portions of the cam shaft 350. The second rotation shaft 354 is provided on the crank wheel 355. One end 330*b* of the crank rod 330, shown in FIG. 14, is connected to the second rotation shaft 354 so as to be capable of pivoting so that the rotational force of the sector gear 316 is transferred to the cam shaft 350 by the crank rod 330.

The hinge shafts 373 of the holder 370 (shown in FIG. 7) are coupled to holes 353 (shown in FIG. 8) formed in the arms 352 of the cam shaft 350 so as to be capable of pivoting. When the rotation shaft 412 of the feed roller 410 is rotated in the reverse direction, the holder 370 is rotated by the arms 352 of the cam shaft 350. The kickers 372 push the end portion 510 of the paper 500 to be discharged from the printer. However, when the rotation shaft 412 of the feed roller 410 rotates in the forward direction, since the holder 370 does not rotate, the kickers 372 do not prevent feeding of the paper 500.

Figure 9:
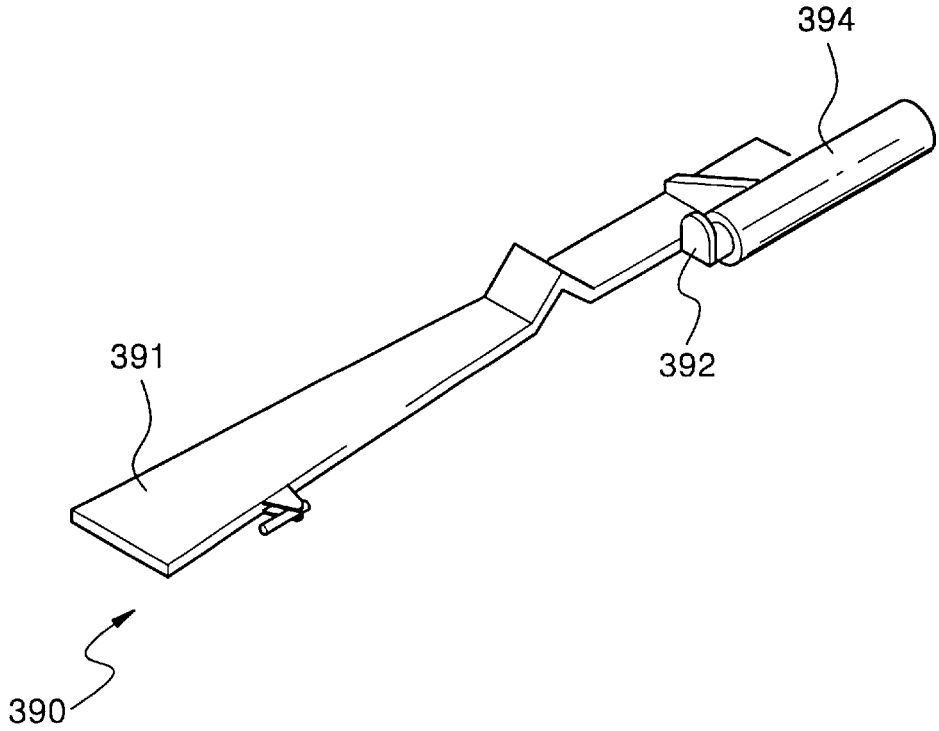
FIG. 9 is a perspective view showing the support plate of the paper discharging apparatus according to the first preferred embodiment of the present invention.

FIG. 9 shows the support plate 390 of the paper discharging apparatus for a printer according to the first preferred embodiment of the present invention. Referring to the drawing, the support plate 390 includes a wing 391 for supporting the paper 500, a torsion bar spring 394 connected to the wing 391 for elastically biasing the wing 391 downward, and a support rod 392 installed at a base frame (not shown) for supporting the torsion bar spring 394.

Although the wing 391 is elastically biased downward by the torsion bar spring 394, since the wing 391 is supported by the cam 351 of the cam shaft 350, the support plate 390 can support the paper 500 when the rotation shaft 412 of the feed roller 410 rotates in the forward direction. Since the cam 351 is rotated when the rotation shaft 412 of the feed roller 410 rotates in the reverse direction, the wing 391 is separated from the cam 351 so that the wing 391 pivots downward due to action of the torsion bar spring 394. Thus, the paper 500 being supported by the support plate 390 falls so as-to be loaded in a paper loading tray (not shown).

When the cam 351 returns to its initial position, the wing 391 is supported by the cam 351 so that the next paper can be supported.

The operation of the paper discharging apparatus for a printer according to the first preferred embodiment of the present invention is described as follows.

The rotation shaft 412 connected to the rotation wheel 413 is rotated by a driving unit (not is shown). When the rotation shaft 412 rotates in the forward direction (counterclockwise), the paper 500 is supplied by being inserted between the feed roller 410 and the pinch roller 420, and printing is performed. When the supply of the paper 500 or printing is completed, the rotation shaft 412 rotates in the reverse direction (clockwise) so that the paper 500 is discharged from the printer by the kickers 372 of the holder 370. The rotation time of the rotation shaft 412 is determined according to the degree of progress of the paper 500 as detected by a detecting sensor (not shown).

In the operation of the paper discharging apparatus for a printer, when the rotation shaft 412 rotates in the forward direction (counterclockwise), the discharge gear 311 rotates. Then the idle gears 312, 313 and 314 provided at the toggle plate 315 installed adjacent to the discharge gear 311 are rotated by being engaged with the discharge gear 311.

Figure 10A:
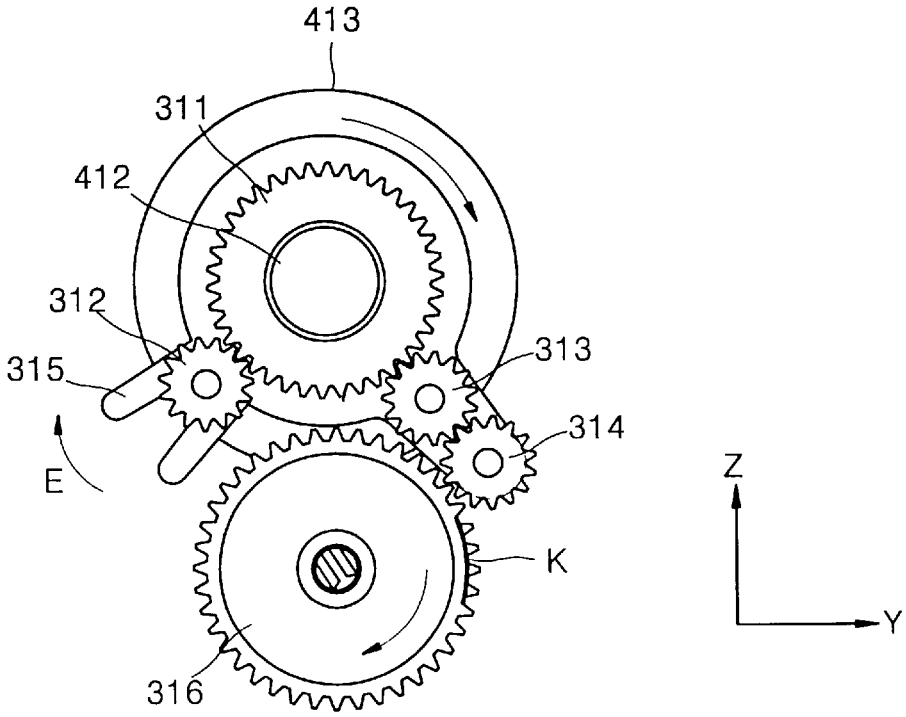
FIGS. 10A and 10B are views showing the operation of the toggle plate when the paper discharging apparatus of FIG. 4 rotates in the forward direction.
Figure 10B:
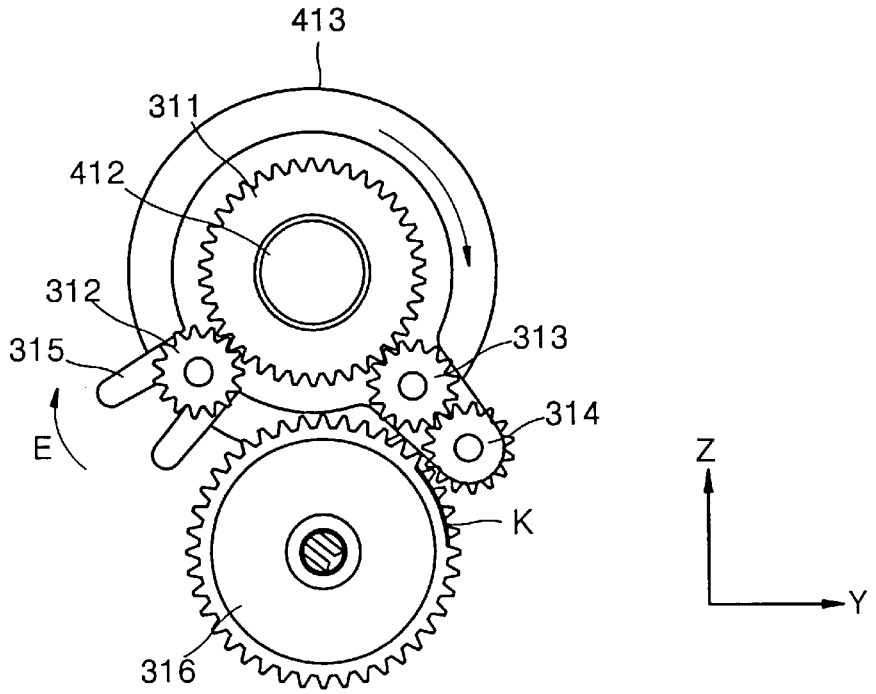
Figure 11:
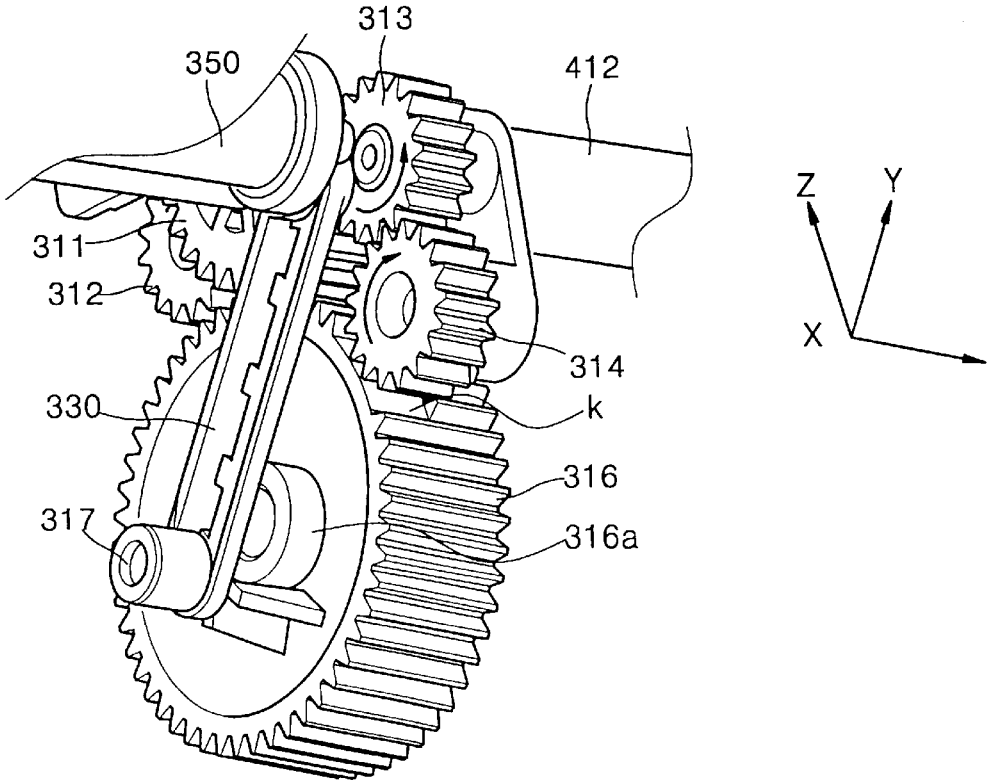
FIG. 11 is a perspective view showing the operation of the power transfer portion when the paper discharging apparatus of FIG. 4 rotates in the forward direction.

FIGS. 10A and 10B show the operation of the toggle plate 315 during a forward directional rotation. FIG. 11 shows the operation of the power transfer portion 310 according to the first preferred embodiment of the present invention during forward directional rotation.

Referring to FIGS. 10A, 10B and 11, as the toggle plate 315 rotates in a direction indicated by an arrow E, the third idle gear 314 contacts the sector gear 316. At first, the third idle gear 314 is engaged with about two teeth of the sector gear 316 so that the sector gear 316 is rotated.

The first idle gear 312 rotates by being engaged with teeth provided in the area D of the sector gear 316. Thereafter, the first idle gear 312 meets the first flat portion M of the sector gear 316 where no teeth are provided, and the first idle gear 312 no longer rotates so that the sector gear 316 does not rotate any further. Accordingly, when the discharge gear 311 rotates in the reverse direction, the sector gear 316 cannot be located at a position so as to be engaged with the first idle gear 312. Thus, as the third idle gear 314 rotates by being engaged with about two teeth provided in the area C of the sector gear 316, the first idle gear 312 can be located at the original position so as to be engaged with the teeth provided in the area D of the sector gear 316.

However, after the engagement of the third idle gear 314 with about two teeth of the sector gear 316 is completed, the third idle gear 314 meets the second flat portion K where no teeth are formed. Thus, since the third idle gear 314 is not engaged with teeth at the second flat portion K, the sector gear 316 does not rotate.

Figure 12:
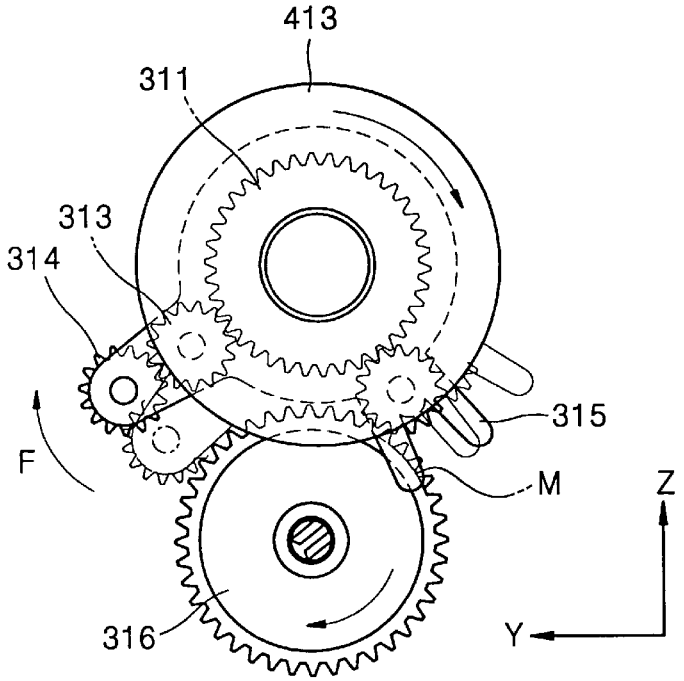
FIG. 12 is a view showing the operation of the power transfer portion when the paper discharging apparatus of FIG. 4 rotates in the reverse direction.
Figure 13:
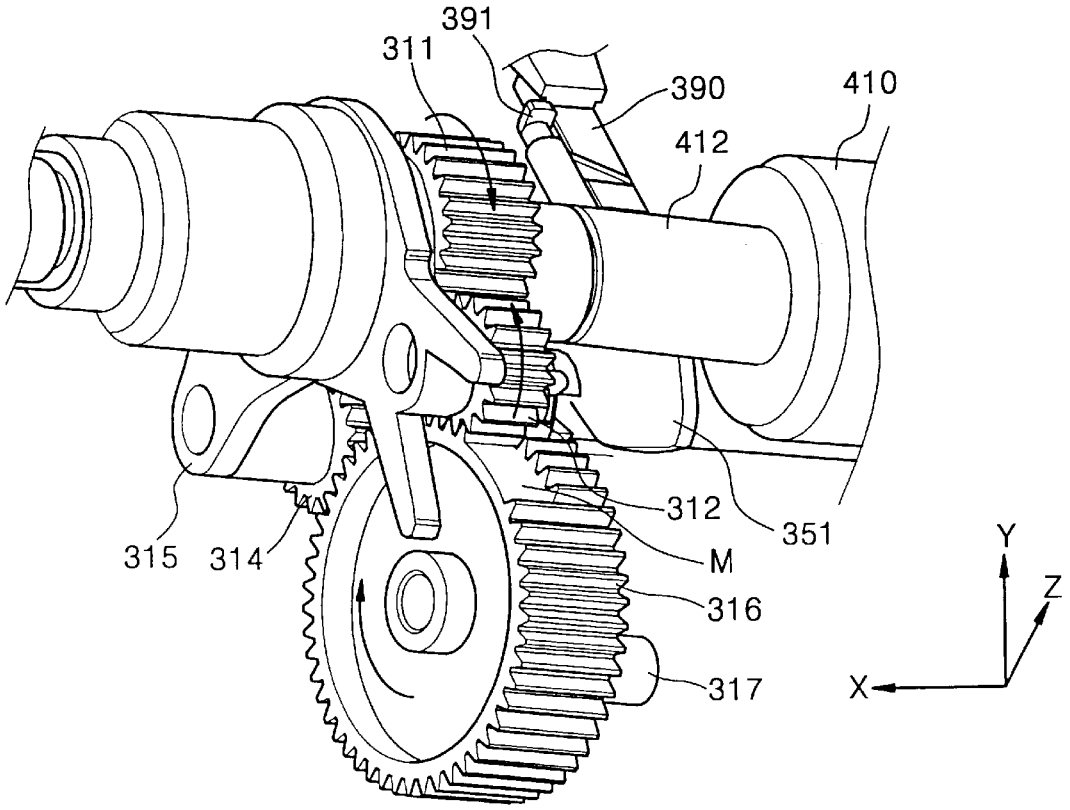
FIG. 13 is a perspective view showing the operation of the power transfer portion when the paper discharging apparatus of FIG. 4 rotates in the reverse direction.

The operation of the paper discharging apparatus for a printer when the rotation shaft 412 rotates in the reverse direction (clockwise) is now described as follows. FIG. 12 shows the operation of the toggle plate 315 according to the first preferred embodiment of the present invention when rotating in the reverse direction. FIG. 13 shows the operation of the power transfer portion 310.

Referring to FIGS. 12 and 13, when the discharge gear 311 rotates, the toggle plate 315 (located at a position indicated by a dotted line) rotates in a direction indicated by an arrow F so that the first idle gear 312 is engaged with the sector gear 316. Thus, the sector gear 316 rotates clockwise.

The first rotation shaft 317 is provided at the sector gear 316, and one end 330*a* of the crank rod 330 is connected to the first rotation shaft 317. The other end 330*b* of the crank rod 330 is connected to the second rotation shaft 354 provided at the crank wheel 355.

FIG. 14 shows the operation of the crank rod 330 and the cam shaft 350 according to the first preferred embodiment of present invention. Referring to the drawing, when the sector gear 316 rotates, the crank rod 330 connected to the first rotation shaft 317 moves in a direction indicated by an arrow G. Also, the crank rod 330 is connected to the second rotation shaft 354 provided at the crank wheel 355 of the cam shaft 350 so that the cam shaft 350 rotates by an angle θ. When the sector gear 316 continues to rotate, the crank rod 330 moves in a direction indicated by an arrow H, and the cam shaft 350 returns to its original position. Thus, as the crank rod 330 reciprocates, the cam shaft 350 performs an angular movement by the angle θ and moves through an arc I of the cam shaft 350.

After the sector gear 316 completes one rotation, the first idle gear 312 is not engaged with the sector gear 316 at the first flat portion M so that the sector gear 316 is not rotated any longer. Thus, there is a need to move the first idle gear 312 so as to be engaged with the sector gear 316 again. Accordingly, as shown in FIG. 10A, during forward directional rotation, when the third idle gear 314 is rotated by being engaged with about two teeth provided in the area C of the sector gear 316, the first idle gear 312 is engaged with the teeth of the area D of the sector gear 316.

Figure 15A:
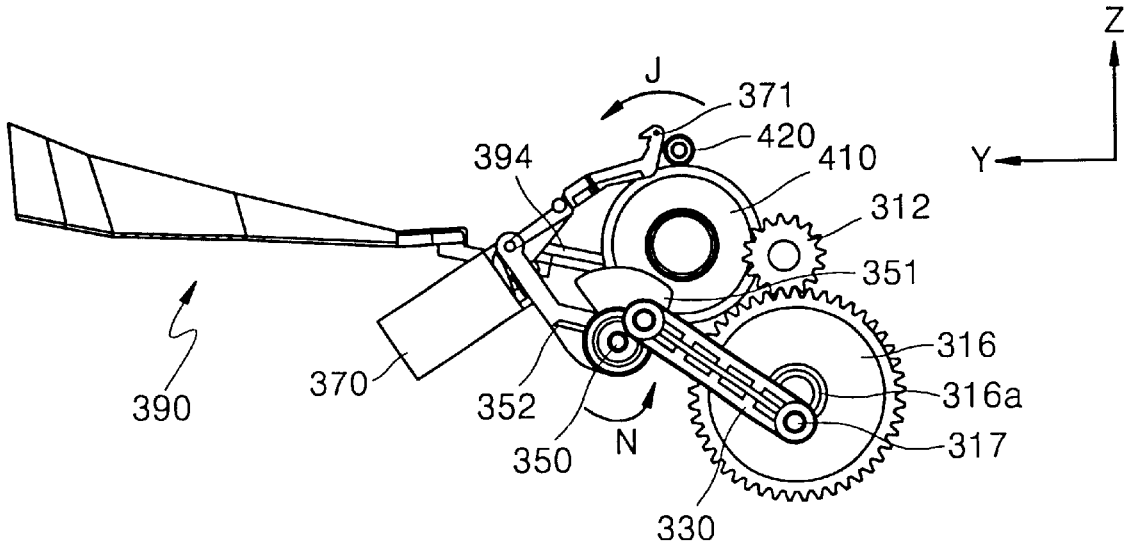
FIGS. 15A and 15B are views showing the operation of the holder and the support plate when the paper discharging apparatus of FIG. 4 rotates in the reverse direction.
Figure 15B:
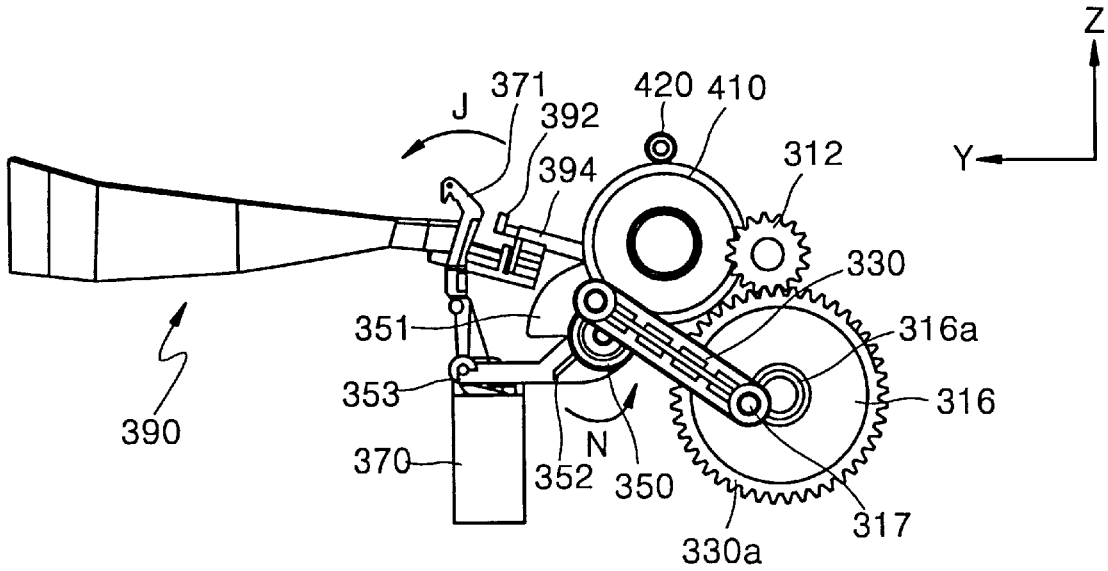

FIGS. 15A and 15B show the operations of the holder 370 and the support plate 390 of the paper discharging apparatus according to the first preferred embodiment of the present invention during reverse directional rotation. Referring to the drawings, when the cam shaft 350 is moved by the crank rod 330 through the angle θ in a direction indicated by an arrow N, simultaneously, the arm 352 installed at the cam shaft 350 rotates the holder 370 in a direction indicated by an arrow J. The kicker 372 of the holder 370 pushes the end portion 510 of the paper 500. When the cam shaft 350 rotates by the angle θ, the kicker 372 completely pushes the paper 500.

Meanwhile, when the cam 351 of the cam shaft 350 begins to rotate by the angel θ, the cam 351 is separated from the wing 391 supporting the paper 500. The wing 391 is rotated downward by an elastic restoring force of the torsion bar spring 394. Thus, the paper 500 supported by the wing 391 drops downward, and is stacked in a paper containing tray (not shown).

Referring to FIG. 14, the cam shaft 350 returns to its original position as the crank rod 330 moves in the direction H. The holder 370 is returned to its original position by the arm 352 installed on the cam shaft 350, and the wing 391 is supported by the cam 351. The torsion bar spring 394 is elastically biased to provide an elastic restoration force. The holder 370 is in a state of being able to support the next paper.

Figure 16:
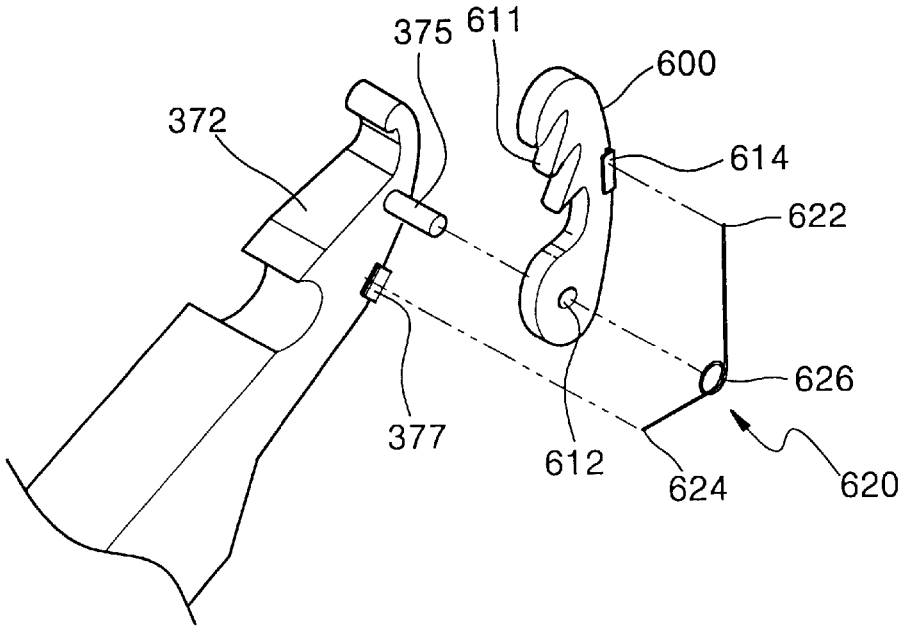
FIG. 16 is an exploded perspective view showing the holder having a rake according to a second preferred embodiment of the present invention.
Figure 17A:
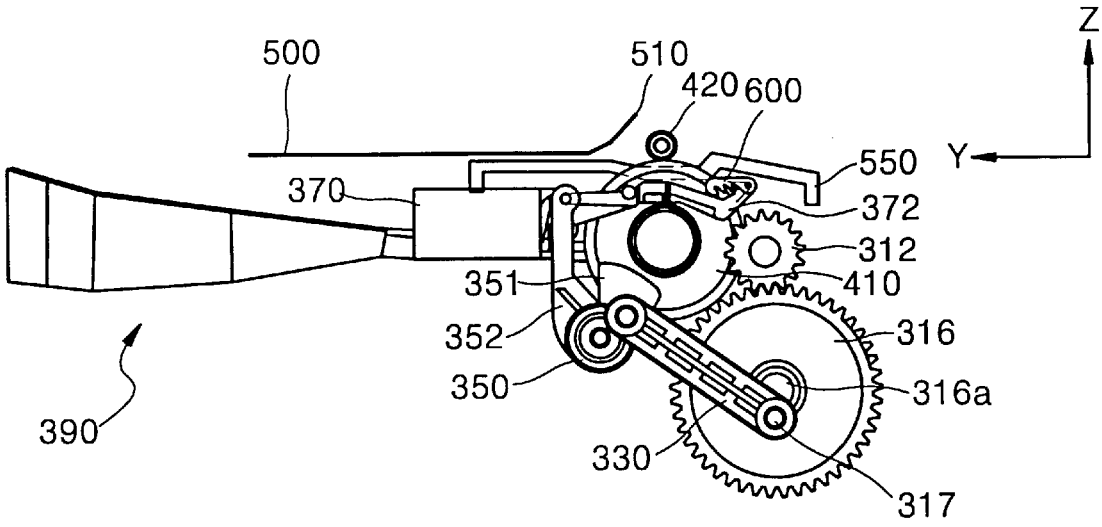
FIGS. 17A and 17B are views showing the operation of the rake according to the second preferred embodiment of the present invention.
Figure 17B:
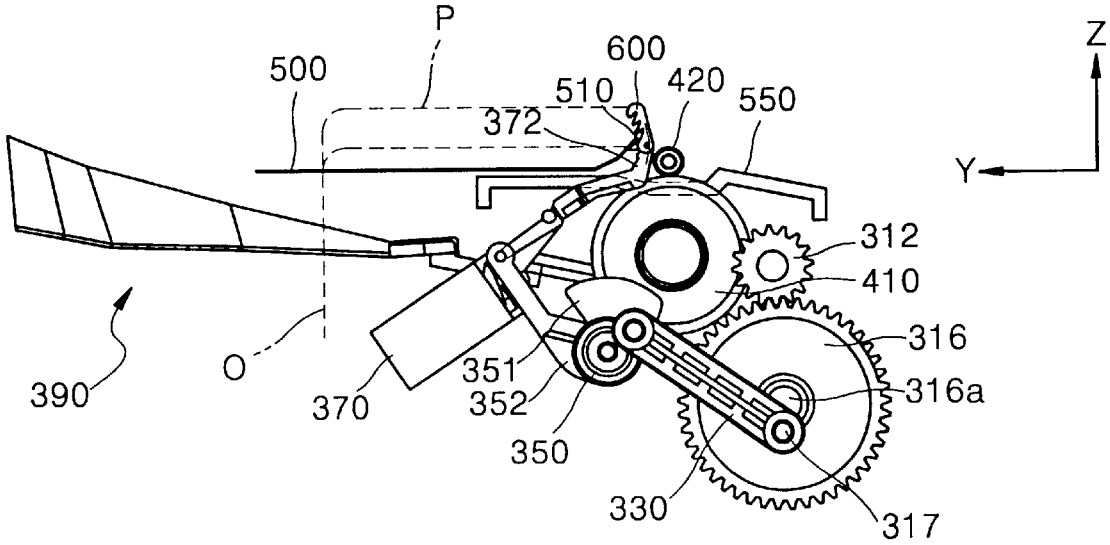

FIG. 16 shows a holder having a rake according to a second preferred embodiment of the present invention. FIGS. 17A and 17B show the operation of the paper discharging apparatus according to the second preferred embodiment of the present invention. Here, identical reference numerals are used to indicate identical elements having identical functions as described in the first preferred embodiment of the present invention.

Referring to FIG. 16, a rake 600 includes a saw-toothed step 611, a through hole 612, and a first stopper 614. A protrusion 375, corresponding to the through hole 612, and a second stopper 377 are provided on the kicker 372 of the holder 370. The protrusion 375 is inserted in the through hole 612 so that the rake 600 can rotate with respect to the protrusion 375. Both end portions 622 and 624 of the torsion spring 620 are supported by the first and second stoppers 614 and 377, respectively. A central portion 626 of the torsion spring 620 is inserted around the protrusion 375. Thus, when the rotation shaft 412 of the feed roller 410 rotates in a forward direction, the rake 600 is hidden by a base frame 550, shown in FIGS. 17A and 17B. The torsion spring 620 maintains an elastic restoring force. When the rotation shaft 412 of the feed roller 410 rotates reversely, the kicker 372 of the holder 370 is rotated by the arm 352 of the cam shaft 350. Then, the rake 600 is separated from the base frame 550, and the rake 600 is separated from the kicker 372 by the elastic restoring force maintained by the torsion spring 620. When the kicker 372 returns to its original position, the rake 600 becomes hidden by the base frame 550.

The operation of the paper discharging apparatus for a printer according to the second preferred embodiment of the present invention is now described with reference to FIGS. 17A and 17B.

Referring to the drawings, when the paper 500 is printing or simply feeding, the rake 600 is pressed and hidden by the base frame 550. Although the torsion spring 620 tries to push the rake 600 upward against the kicker 372, since the rake 600 is pressed by the base frame 550, the torsion spring 620 maintains an elastic restoring force.

When the transfer of the paper 500 between the pinch roller 420 and the feed roller 410 is completed, the holder 370 is connected to the arm 352 provided at the cam shaft 350, and is rotated so that the kicker 372 is rotated. Since the rake 600, pressed by the base frame 550, is separated from the base frame 550, the rake 600 is separated from the kicker 371 by the elastic restoring force of the torsion spring 620.

When a curl is generated in the paper 500 so that the end portion 510 of the paper 500 is raised upward, as the holder 370 rotates, the kicker 372 moves along a path indicated by a dotted line O, while the rake 600 moves along a path indicated by a dotted line P. Thus, since the rake 600 is located above the position of the end portion 510 of the paper 500 which is curled up, the rake 600 pushes the end portion 510 of the paper 500 so that the paper 500 is discharged.

Thus, the paper discharging apparatus for a printer according to the second preferred embodiment of the present invention discharges the paper 500 by using the rake 600, even when the end portion 510 of the paper 500 is curled up.

As described above, the paper discharging apparatus for a printer according to the present invention has the following advantages.

First, since a power transfer portion, a simple crank rod and a cam shaft capable of rotating in a forward or reverse direction are used, the cost can be reduced and printing speed can be improved.

Second, since actions to hold and stack the discharged paper can be performed by the crank rod and the cam shaft, the discharge paper can be stably stacked without being damaged.

Third, even when the paper curl is generated, the paper can be stably discharged from the printer.

Although the preferred embodiments of the present invention have been described, it will be understood by those skilled in the art that the present invention should not be limited to the described preferred embodiment. Rather, various changes and modifications can be made within the spirit and scope of the present invention, as defined by the following claims.

What is claimed is:

1. A paper discharging apparatus for a printer, comprising:

a plurality of support plates for supporting the paper, said support plates being installed on both sides of a paper proceeding direction on a base frame and rotating in a direction parallel to the paper proceeding direction;

a rotation shaft of a feed roller disposed in a direction perpendicular to the paper proceeding direction, said feed roller contacting the paper and being coupled to said rotation shaft;

a power transfer portion having a sector gear installed on the rotation shaft so that the sector gear does not rotate when the rotation shaft rotates in a forward direction and rotates when the rotation shaft rotates in a reverse direction;

a crank rod having an end connected to the sector gear and reciprocating when the sector gear rotates;

a cam shaft connected to the crank rod and rotating in correspondence to the reciprocation of the crank rod, and connected to a cam for performing interference movement relative to the support plates; and a holder rotatably engaged with the cam shaft and having a plurality of kickers for pushing the paper toward the support plates;

wherein, when the sector gear rotates in the forward direction, the paper is supplied for printing, and when the sector gear rotates in the reverse direction, the holder is engaged with the cam shaft by the crank rod connected to the sector gear so that the end portion of the paper is pushed, and the paper is supported by the support plates, dropped downward and stacked.

2. The apparatus as claimed in claim 1, wherein the power transfer portion further comprises:

a discharge gear coupled to the rotation shaft of the feed roller;

a plurality of idle gears rotating by being engaged with the discharge gear; and a toggle plate to which the idle gears are installed, and having a through hole formed therein and through which the rotation shaft of the feed roller passes.

3. The apparatus as claimed in claim 2, wherein the plurality of idle gears comprise first, second and third idle gears, the first and second idle gears being engaged with the discharge gear at a predetermined angle, the third idle gear being engaged with the second idle gear, the first idle gear being located at a side where the paper enters, and the second and third idle gears being located at a side where the paper is discharged.

4. The apparatus as claimed in claim 3, wherein the first and second idle gears are engaged with different area portions of the sector gear, said sector gear being divided in an axial direction thereof to form the different area portions.

5. The apparatus as claimed in claim 3, wherein the toggle plate pivots in a forward direction when the discharge gear rotates in the forward direction so that the third idle gear is engaged with the sector gear, and the toggle plate pivots in a reverse direction when the discharge gear rotates in the reverse direction so that the first idle gear is engaged with the sector gear.

6. The apparatus as claimed in claim 3, wherein the sector gear includes a first flat portion where no teeth are formed in a predetermined width corresponding to the first idle gear so that the sector gear rotates only one rotation by being engaged with the first idle gear when the discharge gear rotates in a reverse direction.

7. The apparatus as claimed in claim 3, wherein the sector gear includes a second flat portion where no teeth are formed in a predetermined width corresponding to the third idle gear so that the sector gear is not engaged with the third idle gear when the discharge gear rotates in a forward direction.

8. The apparatus as claimed in claim 3, wherein a face width of the sector gear is no less than a sum of face widths of the first and third idle gears.

9. The apparatus as claimed in claim 2, wherein the plurality of idle gears comprise first, second and third idle gears, the third idle gear being engaged with the second idle gear, the first idle gear being located at a side where the paper enters, and the second and third idle gears being located at a side where the paper is discharged.

10. The apparatus as claimed in claim 9, wherein the first and second idle gears are engaged with different area portions of the sector gear, said sector gear being divided in an axial direction thereof to form the different area portions.

11. The apparatus as claimed in claim 9, wherein the sector gear includes a first flat portion where no teeth are formed in a predetermined width corresponding to the first idle gear so that the sector gear rotates only one rotation by being engaged with the first idle gear when the discharge gear rotates in a reverse direction.

12. The apparatus as claimed in claim 9, wherein the sector gear includes a second flat portion where no teeth are formed in a predetermined width corresponding to the third idle gear so that the sector gear is not engaged with the third idle gear when the discharge gear rotates in a forward direction.

13. The apparatus as claimed in claim 1, wherein a first end of the crank rod is coupled to a first rotation shaft provided at an eccentric position with respect to a center shaft of the sector gear so as to be capable of pivoting.

14. The apparatus as claimed in claim 13, wherein a first end of the cam shaft is coupled to a crank wheel, and a second end of the crank rod is coupled to a second rotation shaft provided at an eccentric position of the crank wheel so as to be capable of pivoting.

15. The apparatus as claimed in claim 1, wherein the cam shaft comprises a plurality of arms for rotating the holder.

16. The apparatus as claimed in claim 1, wherein each of the support plates comprises:

a wing for supporting edges of the paper;

a torsion bar spring connected to the wing for elastically biasing the wing downward; and a support rod installed on the base frame for supporting the torsion bar spring.

17. The apparatus as claimed in claim 16, wherein a saw-toothed rake is coupled to the kickers so as to be capable of pivoting so that an end portion of the paper, when curled up, is pushed to be discharged, the rake being elastically biased by the torsion bar spring, and the rake being separated from the kickers by the torsion bar spring as the kickers rotate.

18. A paper discharging apparatus for a printer, comprising:

a plurality of support plates for supporting the paper, said support plates being installed on both sides of a paper proceeding direction on a base frame and rotating in a direction parallel to the paper proceeding direction;

a rotation shaft of a feed roller disposed in a direction perpendicular to the paper proceeding direction, said feed roller contacting the paper and being coupled to said rotation shaft;

a power transfer portion having a sector gear installed on the rotation shaft so that the sector gear does not rotate when the rotation shaft rotates in a forward direction and rotates when the rotation shaft rotates in a reverse direction;

a crank rod having an end connected to the sector gear and reciprocating when the sector gear rotates;

a cam shaft connected to the crank rod and rotating in correspondence to the reciprocation of the crank rod, and connected to a cam for performing interference movement relative to the support plates; and a holder rotatably engaged with the cam shaft and having a plurality of kickers for pushing the paper toward the support plates;

wherein the power transfer portion further comprises:

a discharge gear coupled to the rotation shaft of the feed roller;

a plurality of idle gears rotating by being engaged with the discharge gear; and a toggle plate to which the idle gears are installed, and having a through hole formed therein and through which the rotation shaft of the feed roller passes.

19. The apparatus as claimed in claim 18, wherein the plurality of idle gears comprise first, second and third idle gears, the first and second idle gears being engaged with the discharge gear at a predetermined angle, the third idle gear being engaged with the second idle gear, the first idle gear being located at a side where the paper enters, and the second and third idle gears being located at a side where the paper is discharged.

20. The apparatus as claimed in claim 19, wherein the first and second idle gears are engaged with different area portions of the sector gear, said sector gear being divided in an axial direction thereof to form the different area portions.

21. The apparatus as claimed in claim 19, wherein the toggle plate pivots in a forward direction when the discharge gear rotates in the forward direction so that the third idle gear is engaged with the sector gear, and the toggle plate pivots in a reverse direction when the discharge gear rotates in the reverse direction so that the first idle gear is engaged with the sector gear.

22. The apparatus as claimed in claim 19, wherein the sector gear includes a first flat portion where no teeth are formed in a predetermined width corresponding to the first idle gear so that the sector gear rotates only one rotation by being engaged with the first idle gear when the discharge gear rotates in a reverse direction.

23. The apparatus as claimed in claim 19, wherein the sector gear includes a second flat portion where no teeth are formed in a predetermined width corresponding to the third idle gear so that the sector gear is not engaged with the third idle gear when the discharge gear rotates in a for ward direction.

24. The apparatus as claimed in claim 19, wherein a face width of the sector gear is no less than a sum of face widths of the first and third idle gears.

25. The apparatus as claimed in claim 18, wherein a first end of the crank rod is coupled to a first rotation shaft provided at an eccentric position with respect to a center shaft of the sector gear so as to be capable of pivoting.

26. The apparatus as claimed in claim 25, wherein a first end of the cam shaft is coupled to a crank wheel, and a second end of the crank rod is coupled to a second rotation shaft provided at an eccentric position of the crank wheel so as to be capable of pivoting.

27. The apparatus as claimed in claim 18, wherein the can shaft comprises a plurality of arms for rotating the holder.

28. The apparatus as claimed in claim 18, wherein each of the support plates comprises:

a wing for supporting edges of the paper;

a torsion bar spring connected to the wing for elastically biasing the wing downward; and a support rod installed on the base frame for supporting the torsion bar spring.

29. A paper discharging apparatus for a printer, comprising:

a plurality of support plates for supporting the paper, said support plates being installed on both sides of a paper proceeding direction on a base frame and rotating in a direction parallel to the paper proceeding direction;

a rotation shaft of a feed roller disposed in a direction perpendicular to the paper proceeding direction, said feed roller contacting the paper and being coupled to said rotation shaft;

a power transfer portion having a sector gear installed on the rotation shaft so that the sector gear does not rotate when the rotation shaft rotates in a forward direction and rotates when the rotation shaft rotates in a reverse direction;

a crank rod having an end connected to the sector gear and reciprocating when the sector gear rotates;

a cam shaft connected to the crank rod and rotating in correspondence to the reciprocation of the crank rod, and connected to a cam for performing interference movement relative to the support plates; and a holder rotatably engaged with the cam shaft and having a plurality of kickers for pushing the paper toward the support plates;

wherein a saw-toothed rake is coupled to the kickers so as to be capable of pivoting so that an end portion of the paper, when curled up, is pushed to be discharged.

30. The apparatus as claimed in claim 29, wherein each of the support plates comprises:

a wing for supporting edges of the paper;

a torsion bar spring connected to the wing for elastically biasing the wing downward; and a support rod installed on the base frame for supporting the torsion bar spring.

31. The apparatus as claimed in claim 30, wherein the rake is elastically biased by the torsion bar spring, and the rake is separated from the kickers by the torsion bar spring as the kickers rotate.

* * * * *